United States Patent [19]

Bernardelli et al.

[11] 4,133,610

[45] Jan. 9, 1979

[54] OPTIMUM PRECLEAN CORONA CURRENT FOR ELIMINATING THE ACCUMULATION OF CONTAMINANTS FROM DEVELOPERS

[75] Inventors: William J. Bernardelli, Longmont; Allison H. Caudill, Lafayette; John A. Thompson, Boulder, all of Colo.

[73] Assignee: International Business Machines Corporation, Armonk, N.Y.

[21] Appl. No.: 866,112

[22] Filed: Dec. 30, 1977

[51] Int. Cl.[2] ..... G03G 15/00

[52] U.S. Cl. ..... 355/3 CH; 96/1 C; 355/14; 355/15; 361/225

[58] Field of Search ..... 355/15, 3 CH, 14; 250/324–326; 118/652; 96/1 C; 361/225, 226

[56] References Cited

U.S. PATENT DOCUMENTS

| | | | |
|---|---|---|---|
| 3,348,523 | 10/1967 | Davidson et al. | 355/14 X |
| 3,884,572 | 5/1975 | Bacon et al. | 355/15 |
| 3,950,680 | 4/1976 | Michaels et al. | 355/3 CH |
| 4,039,257 | 8/1977 | Connolly | 355/14 X |

*Primary Examiner*—Richard L. Moses
*Attorney, Agent, or Firm*—Charles E. Rohrer

[57] ABSTRACT

An electrophotographic machine of the transfer type in which tetrafluoroethylene-coated carrier beads transport toner particles to a development zone by virute of the triboelectric attraction between positive toner and negative tetrafluoroethylene. At the development zone, the carrier beads are crushed together and occasionally a piece of tetrafluoroethylene is worn off of the surface of the beads and carried along on the surface of the photoconductor. These tetrafluoroethylene-wear products are subjected to high level preclean corona current to reverse the triboelectric negative polarity thereof. In that manner, a positive wear product is made to act as though it was toner and is therefore carried out of the machine on copy paper. In a similar manner, paper dust and other contaminants on the photoconductor surface are subjected to a high level preclean corona current to receive a positive charge for being carried out of the machine on the copy paper.

6 Claims, 4 Drawing Figures

OPTIMUM PRECLEAN CORONA CURRENT FOR ELIMINATING THE ACCUMULATION OF CONTAMINANTS FROM DEVELOPERS

This invention relates to electrophotographic machines and more particularly to a method for setting the optimum preclean corona current in order to remove tetrafluoroethylene-wear products, paper dust, wrongly-charged toner and other contaminants from the system.

BACKGROUND OF THE INVENTION

In electrophotographic machines of the transfer type, a moving photoconductor is charged to a relatively uniform level by a charging corona. The charged photoconductor is then imaged in order to produce a replica of an original on the photoconductor by variably discharging the charged photoconductor according to the image of the original. At this step in the process areas of the original which are white or light in background reflect or transmit a significant amount of light which, when reaching the photoconductor, discharge the photoconductor to an appropriate level. On the other hand, black or gray areas of the original document transmit or reflect much less light and therefore in these regions the photoconductor retains a significant charge. The next step in the process is to apply a developer to the image which may typically be a powder with a triboelectric charge of a polarity to be attracted to the undischarged portions of the photoconductor. Since the undischarged portions represent the black portions, a black toner is normally used in order to provide black copy, although in color copiers various other shades of toner are also used. After development the photoconductor moves to a position at which the developed image is transferred to a piece of copy paper or some other receiving medium. Transfer is effected through a corona generator which places a charge on the reverse side of the copy paper so as to attract the toner away from the photoconductor and onto the front side of the paper. After completing transfer the receiving medium passes through a fuser at which the toner is fused onto the copy paper or receiving medium and from there the copy paper passes out of the machine. The photoconductor, meanwhile, after the transfer is completed, continues to move to a cleaning station at which any remaining toner not transferred to the copy paper is cleaned from the photoconductor. The cleaned photoconductor then enters the charging station for a resumption of the copy cycle.

After transfer and prior to entering the cleaning station, it is necessary to neutralize the charge on the surface of the photoconductor by passing the photoconductor under a precleaning corona which is of opposite polarity to the charging corona. The photoconductor is also typically moved through the influence of an erase light in order to utilize light as a discharging medium for any remaining photoconductor charge. In that manner the cleaning station can operate to best advantage.

In the electrophotographic process a photoconductor may initially be charged either positive or negative depending generally upon the properties of the photoconductor chosen. Suppose that the charge on a particular photoconductor is negative. The result of imaging such a photoconductor is to leave a relatively low negative charge in all-white or lightly colored areas of the image and to leave relatively high negatively-charged areas in black or darkly colored areas of the image. Since it is desired to attract a toner to the highly negative areas the toner itself should take a positive charge. This charge is typically quite small since it is only that natural charge which is triboelectrically a part of the material used. Therefore, where the photoconductor is charged to a negative value the proper toner material will carry a positive triboelectric charge.

In magnetic brush developers, a magnetic material such as steel is ordinarily used as a carrier bead to move the toner from a sump area to the developing area. As a magnetic brush rotates, the steel carrier bead with the toner coated thereon is attracted to the rotating magnetic brush and rotates with the brush into the developing zone whereat the positive toner can be attracted to the negatively charged image. In order to ensure that the toner will be carried by the steel bead the steel is coated with tetrafluoroethylene, a synthetic resin which carries a natural triboelectric negative charge. Consequently, the positive toner is held by an electrical attraction to the negative tetrafluoroethylene-coated steel bead which is in turn magnetically attracted to the rotating developing brush. At the development area the triboelectric charge attraction between the positive toner and the negative coating is overcome by the more powerful negative charge on the photoconductor and in addition, due to the mechanical agitation at the developer area of the carrier and toner particles which tends to mechanically dislodge the toner from the carrier.

It has been found in systems utilizing tetrafluoroethylene-coated carrier particles that over a period of use small pieces of the coating are worn away from the bead and become a part of the developing process. Typically these tetrafluoroethylene-wear products are produced during the mechanical agitation at the development zone where the carrier beads are squeezed together as they pass through the restricted area between the surface of the magnetic brush and the surface of the photoconductor. These small wear particles retain their negative triboelectric charge and are attracted to the positive toner which in turn is attracted in great amount to the highly negatively charged photoconductor. The result often is that the small wear products leave the developing area on the surface of the photoconductor riding on the toner. The wear product, while quite small, may in some cases be considerably larger than the very small particles of toner and as a consequence it may create difficulties at the transfer station, causing imperfections in the reproduced copy. Note that since the tetrafluoroethylene carries a negative triboelectric charge it will not be attracted to the surface of the copy paper since the transfer corona is a negative corona intended to build up negative charge on the back side of the copy paper so that the positively charged toner is attracted from the photoconductor to the copy paper. That electrical system, however, repels the tetrafluoroethylene-wear product and therefore they continue to reside on the surface of the photoconductor after the photoconductor moves away from the transfer station. Hopefully, these particles will be cleaned off of the photoconductor at the cleaning station. If they are not successfully cleaned from the surface eventually they will be ground into the photoconductor and form a permanent coat called a "clear filming condition." Such a condition destroys the image reproducing qualities of the photoconductor and renders it unsuitable for continued use.

In addition to tetrafluoroethylene-wear products, other contaminants may come to reside on the surface of the photoconductor. For example, at the transfer station, a receiving medium is pressed against the photoconductor and a negative charge is placed on the backside of the paper. Dust may be present on the frontside of the paper and may be triboelectrically negative. As a result, that dust may be transferred to the photoconductor. Another contaminant is negatively-charged toner which, of course, does not transfer.

Having now described the problem and the genesis of contaminants in the electrophotographic process, the inventors herein have surmised that the preclean corona which is designed to neutralize the charge on the photoconductor may also be used to reverse the charge on the tetrafluoroethylene-wear products and other contaminants if the charge density produced by the corona generator is sufficiently high. By bombarding the negatively-charged particle with a sufficient amount of positive charge the particle can be made to assume a positive charge. As a consequence, this now positive contaminating particle can be successfully cleaned from the photoconductor at the cleaning station, together with the non-transferred, positively-charged toner. When a two-cycle process is in use with a combined cleaner/-developer, on subsequent develop cycles the positively-charged contaminant may be attached to the negatively-charged image area in the manner in which toner is attracted. As a result, the contaminating particle rides to the transfer station where it is attracted to the copy paper and leaves the system on the surface of the copy paper. The inventors herein have recognized the value of high preclean corona currents in order to accomplish this objective and have carried this invention further to the point where they have discovered a definite relationship between the value of the transfer current and the proper setting for preclean corona current. The advantages of this invention are important for all electrophotographic machines, especially those which utilize tetrafluoroethylene-coated carrier and are doubly important in a two-cycle process machine in which the developing magnetic-brush roll is also used as the cleaning roll. This is due to the fact that if the negatively-charged contaminants are successfully cleaned from the photoconductor by the developer/cleaner, the particle enters the developer mix to become a part of that mix with the steel carrier beads and the positively-charged toner. As a result, the positively-charged toner is attracted to the negatively-charged contaminant as well as to the negatively-charged coated steel bead. If a sufficient amount of such contaminants exist in the developer mix, the result is to create poorly developed images. It is, therefore, extremely important in a two-cycle process with a combined developer/cleaner for the contaminants to be bombarded with a sufficiently high positive preclean corona current to change the charge on the contaminant from negative to positive. In that manner the contaminating particles will be carried out of the system on the copy paper as previously described and the developing station will continue to produce high quality copy.

It has been observed, however, that there is an upper limit to which the positive preclean corona current can be raised because of another problem called "toner filming" which results from too high corona currents. If a photoconductor becomes coated with toner the result is high background on reproduced copies and in general a lowering of the ability of the photoconductor to charge to its proper levels. This result occurs when the positive charges from the preclean corona build up to a significant extent on the outer surface of the toner remaining after transfer. Remember that the photoconductor was originally charged with a negative charge at the charge corona so that directly under the particle of toner lies a negative charge. With a high positive charge on the outer surface of the toner a significant gradient is established which tends to keep the toner in place on the photoconductor surface. Without that high charge present the attraction between the toner and the photoconductor is usually insufficient to cause a toner filming problem since the gradient can be overcome at the cleaning station where a higher valued negative charge is placed on the magnetic brush to attract the toner away from the photoconductor and back into the developing mix. However, should a high positive charge build up on the outer surface of the toner the negative bias at the cleaning station may be insufficient to clean the toner from the surface. Similarly, if a cleaning brush is used without electrical bias, the attraction between the toner and the photoconductor may be sufficient to prevent its being dislodged from the photoconductor by the cleaning brush. In any event it is clearly undesirable to apply too high a preclean corona current since the result is toner filming of the photoconductor surface.

SUMMARY OF THE INVENTION

In an electrophotographic machine of the transfer type in which contaminants, such as small particles of dust, wrongly charged toner, or particles of tetrafluoroethylene, appear on the surface of the photoconductor, a method for establishing optimum levels of preclean corona charge density involving the steps of setting the transfer corona charge density to a desired level in order to obtain quality copy, and then adjusting the preclean corona charge density to an optimum value nearly equal to the transfer corona charge density. A range of suitable preclean corona charge density values is the transfer corona charge density $\pm 0.025$ microcoulombs per square centimeter. At the lower end of the range a clear (tetrafluoroethylene) filming problem may be present, while at the upper end of the range a toner filming problem may become evident.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
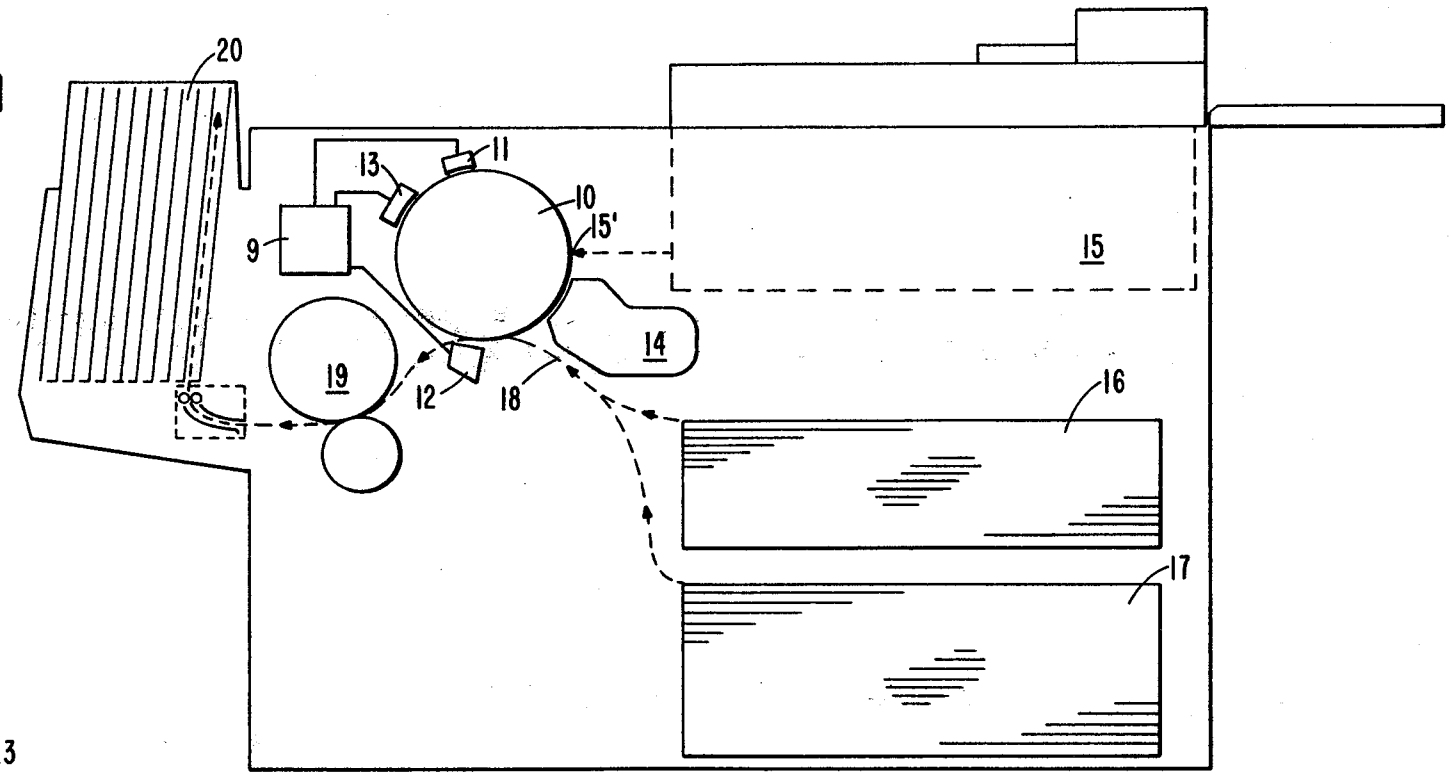
FIG. 1 shows in schematic form the outline of a typical electrophotographic machine of the transfer type utilizing a two-cycle process.

FIG. 1 shows a typical electrophotographic machine in which a two-cycle process is used. In the two-cycle process the developer mechanism may also be used as a cleaning mechanism and therefore any resultant toner remaining on the surface of the photoconductor after transfer is cleaned from that surface directly back into the developer mix. In that manner there is no loss of toner from the system by virtue of the toner being collected in a separate cleaning station. The two-cycle process is particularly valuable for small machines in which the developer has a relatively limited supply of toner and in machines which are not designed for high speed. This latter is true since the photoconductor must take two complete revolutions for each copy produced. On the first revolution the photoconductor is charged, imaged, developed and the image is transferred to copy paper. On the second revolution the photoconductor enters the preclean corona, the erase lamp and the cleaning station.

FIG. 1 shows a machine in which the photoconductor is wound upon the exterior surface of a drum 10. The charging corona is shown at 11, the transfer corona at 12 and the preclean corona at 13. A developer/-cleaner 14 is used to develop an image which is the product of an optical system 15. Two paper supply bins 16 and 17 are shown feeding paper into a paper path 18 through the transfer station into a fusing station 19 and finally into a collator shown at 20.

In operation, the photoconductor on drum 10 is charged by corona 11, passed through the imaging station 15', through the developer 14, past the transfer corona 12, to the preclean corona 13. An erase lamp is not shown on FIG. 1 but could be conveniently located near preclean corona 13. The photoconductor continues to rotate through the station 14 which is now a cleaning station and from there the process continues. Meanwhile the copy paper is fed from either paper supply bin 16 or paper supply bin 17 along the paper path 18 in a manner such that the copy paper mates with the image on the photoconductor. In that manner the developed image is transferred to the copy paper under the influence of the transfer corona 12 and the copy paper continues through the fuser and into the collator 20.

Means for settting and adjusting corona current levels involve an adjustment of the corresponding output from power supply 9. Standard power supplies in existing machines provide this capability. A particularly good power supply is described in IBM docket BO-9-76-042, incorporated herein by reference.

Figure 2:
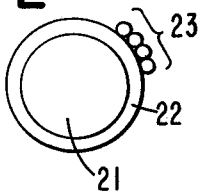
FIG. 2 shows a typical steel carrier bead coated with tetrafluoroethylene and toner.

FIG. 2 shows a greatly enlarged view of a tetrafluoroethylene-coated carrier bead with particles of toner on the surface thereof. A steel core 21 carries the coating 22 to which particles of toner 23 are electrically attracted due to the triboelectric effect.

Figure 3:
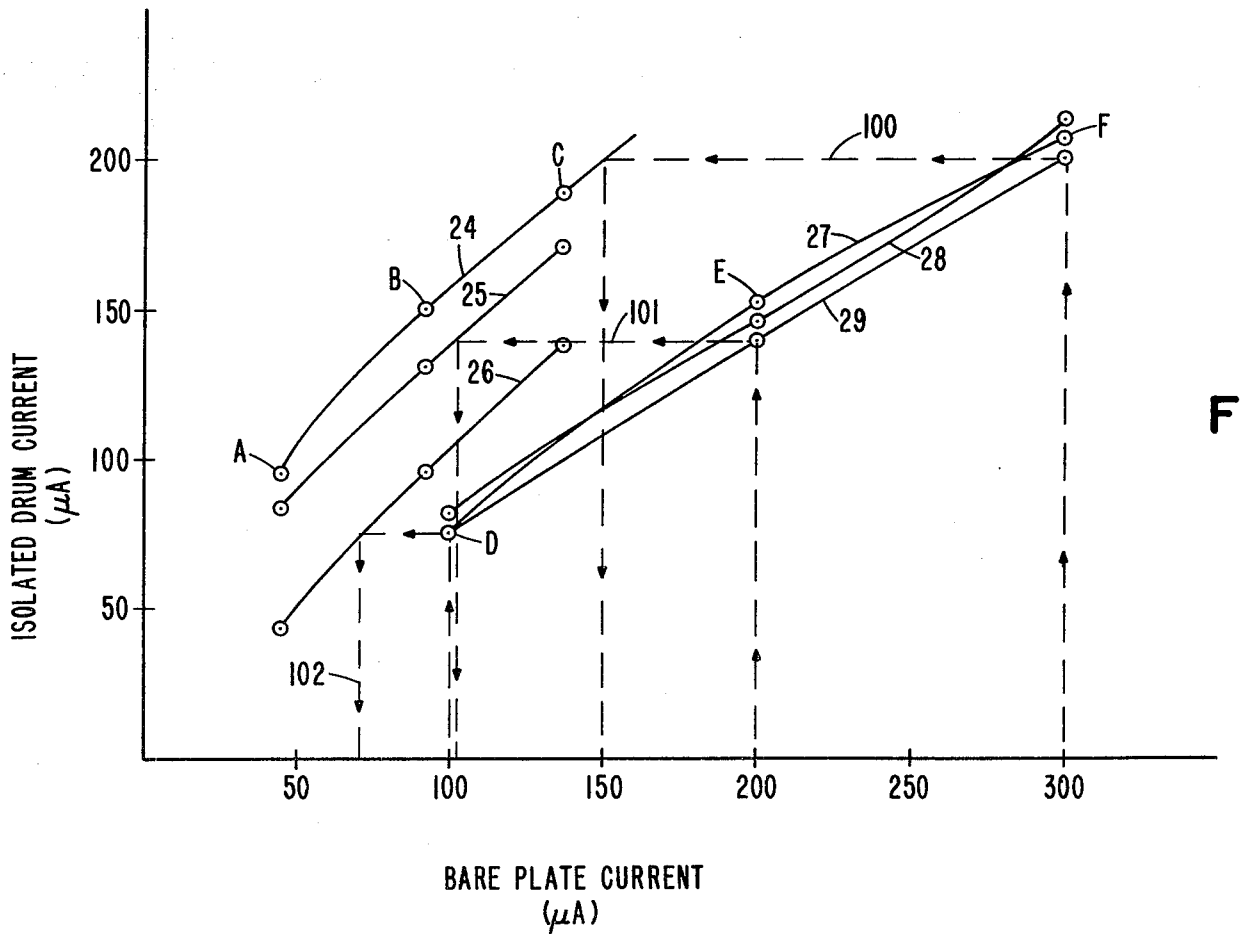
FIG. 3 shows the graphical relationship of the parameters leading to the instant invention.

FIG. 3 is the ingenious graphical plotting of experimental data from which the inventors discovered the relationship constituting the invention. Note that on FIG. 3 bare plate current is plotted against isolated drum current. Bare plate current is defined as that current produced on an aluminum drum held in a stationary position in a copier machine while various corona generators are turned on. Measurement apparatus is attached to the stationary aluminum drum in order to measure the so-called bare plate current.

Isolated drum current is the actual current produced on the actual drum used in the electrophotographic machine. In this case the drum is rotating at normal speed, coronas are turned on, and charge is built up on the surface of the photoconductor, creating a current flow away from the opposite side of the photoconductor into an aluminum backing which in turn is connected to the drum. This current flows out of the drum through bearings or slip rings and on to ground. In order to obtain a measure of the drum current, the drum is isolated from ground and the current is brought off, e.g., through slip rings, into an appropriate meter.

Curve 24 is a plot of isolated drum current against the bare plate current setting for the preclean corona where isolated drum current is measured with both the preclean corona and the transfer corona energized. To obtain curve 24 the transfer corona was set at a constant value of 300 microamps bare plate current and not changed throughout the remainder of the test. The preclean corona current was set at 45 microamps bare plate current. With the two corona currents adjusted at those levels the aluminum bare plate drum was removed from the machine and a normal photoconductor drum placed into the machine. The preclean and transfer coronas were then turned on with the drum rotating and the isolated drum current measured. The result was approximately 95 microamps. In that manner, point A was determined. In a similar manner, the aluminum bare plate was inserted into the machine and the preclean corona current adjusted to a value of 90 microamps. Again, the transfer corona current was adjusted to a bare plate value of 300 microamps. The aluminum drum was then removed from the machine, the normal photoconductor drum replaced and a measurement of the isolated drum current taken. The result, in this case, was a level of 148 microamps. In that manner, point B could be plotted. In a similar manner, the data at point C was obtained and a curve 24 drawn relating the three points.

Curves 25 and 26 were obtained in a similar manner with transfer corona current (bare plate setting) being maintained at 200 microamps for curve 25 and at 100 microamps for curve 26.

Curve 27 was obtained by inserting an aluminum drum into the machine and setting the transfer corona current at 100 microamps. The preclean corona current was set at 90 microamps. The aluminum bare plate drum was then removed and replaced with a normal photoconductor drum. The isolated drum current was measured and was found to be approximately 78 microamps. In that manner point D was plotted. Point E was obtained by continuing the setting of 90 microamps bare plate current on the preclean corona but adjusting the transfer bare plate current to 200 microamps. In this case the isolated drum current was measured to be 150 microamps and point E was plotted. In a similar manner, point F was obtained and curve 27 drawn to connect the three points. In a similar manner curves 28 and 29 were obtained with preclean corona current (bare plate setting) being maintained at 135 microamps for curve 28 and at 45 microamps for curve 29.

FIG. 3 is interesting in that one can note that whatever the value of the bare plate current for the preclean corona as it is held constant a relatively straight line and relatively constant valued curve results. This may be seen by comparing curves 27, 28 and 29. As a consequence, one may draw a curve through the middle region of curves 27, 28 and 29 and have a fair approximation of all three curves. After noting that fact, one can utilize these curves to obtain the optimum preclean current level for any particular transfer corona current level. Suppose, for example, that quality transfer in a particular machine, let us say the machine of FIG. 1, is obtained when the transfer current is set at a bare plate level of 300 microamps. The problem now, as outlined above, is to set the preclean current level so as to remove wear products and other contaminants from the system but not adjust the preclean current level so high that it creates a toner filming problem. Referring to FIG. 3, note that at 300 microamps the curves 27, 28 and 29 have a relatively constant value at near the 200 microamp isolated drum current level. As shown by line 100, if one moves across at the 200 microamp drum current level to reach the constant transfer current at 300 microamps bare plate curve 24, one can then move downward to fine the corresponding preclean current level to balance the transfer current of 300 microamps. Note that the result is approximately 150 microamps or half the transfer current value.

The same procedure can be utilized for a transfer corona setting of 200 microamps bare plate. As shown by line 101, if one utilizes the graph in FIG. 3 to move upward from 200 microamps to the curves 27, 28 and 29 and then across to the curve 25 and then down one finds the preclean corona current level to be at approximately 105 microamps, again approximately one-half the current setting for the transfer corona. In a similar manner, for a bare plate transfer current setting of 100 microamps, line 102 shows a corresponding preclean corona current of approximately 65 microamps.

Figure 4:
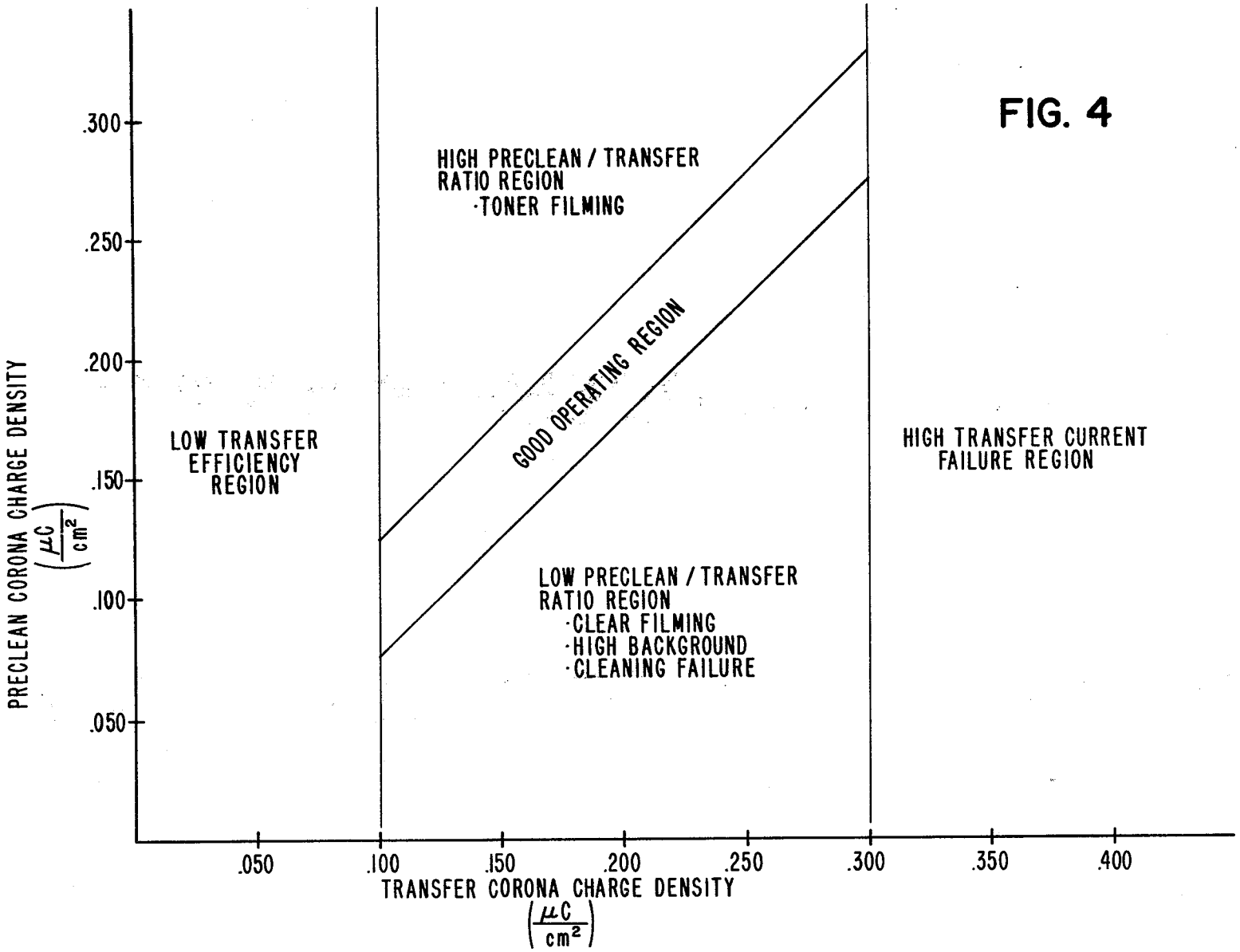
FIG. 4 shows a generalized relationship of the instant invention.

The results obtained from the particular machine tested in FIG. 3 can be generalized as shown in FIG. 4. Particular current levels for a particular machine produce a definite charge density. The same charge density in a different machine might be produced with a different corona current level, since the peripheral speed of the photoconductor and the geometry and size of the corona enter into the production of charge density on the photoconductor surface.

Generally, the relationship is:

$$\text{change density} = \frac{\text{isolated drum current}}{\text{corona length} \times PC \text{ speed}}$$

where PC stands for the periphery of the photoconductor. FIG. 4 is a plot of the generalized relationship and shows that the preclean corona charge density should be about equal to the transfer corona charge density for mid-range setting. As the preclean corona setting moves away from mid-range, increased clear filming or toner filming problems begin to appear. While FIG. 4 sets a definite boundary between good results and problem areas, it should be understood that the problems increase gradually as the preclean charge density is moved away from mid-range.

For purposes of definition, the low transfer efficiency region shown on FIG. 4 is the region where insufficient transfer of toner to the copy paper results. The high transfer current failure region on FIG. 4 is that region where air breakdown occurs, where early transfer of toner to the leading edge of the copy paper occurs, and/or where charge on the backside of the copy paper passes through the paper producing a mottled copy appearance. It has been found, as shown in FIG. 4, that the lower limit of transfer charge density for good transfer is about 0.1 microcoulombs per square centimeter, while the upper limit is approximately 0.3 microcoulombs per square centimeter. FIG. 4 shows that between these two limits the preclean corona charge density level must approximately balance, i.e., equal the transfer corona charge density. FIG. 4 shows that the range for preclean corona setting is the transfer corona charge density ±0.025 microcoulombs per square centimeter. Thus a relatively narrow operating range is defined for the ratio of preclean corona and transfer corona charge density levels.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. An electrophotographic machine of the transfer type including various process stations comprising:

a photoconductor;

means for moving said photoconductor past process stations in said machine;

means for charging said photoconductor at a charging station;

means for producing a latent image on said photoconductor at an imaging station;

means for developing said latent image at a developing station through the application of toner to said latent image;

transfer corona generator means for transferring toner from said photoconductor to a receiving medium at a transfer station;

preclean corona generator means for generating charge at a preclean station opposite in polarity to that generated by said charging means;

a source of tetrafluoroethylene-wear products through which said wear products come to reside on the surface of said photoconductor;

means for adjusting the current of said transfer corona to a level at which the transfer of toner is complete enough to produce quality copy; and means for adjusting the current of said preclean corona to a level which is high enough to prevent tetrafluoroethylene filming of said photoconductor and low enough to prevent toner filming of said photoconductor.

2. The machine of claim 1 wherein the preclean corona current is adjusted to a level sufficient to reverse the polarity of the triboelectric charge on the tetrafluoroethylene-wear products and other contaminants.

3. The machine of claim 2 wherein the preclean corona current is adjusted to an optimum level which is balanced with the level of the transfer corona current so as to produce a charge density equal to transfer corona charge density $\pm$ 0.025 $\mu C/cm^2$.

4. In an electrophotographic machine of the transfer type, including a photoconductor, means for producing a latent image thereon, a developer containing tetrafluoroethylene-coated carrier beads and toner, a transfer corona generator, and a preclean corona generator, wherein said coated carrier beads are used to carry toner particles to a development zone in order to develop a latent image on the machine photoconductor, a method of controlling tetrafluoroethylene-wear products in said machine including the steps of:

(1) adjusting the transfer corona charge density to a level between 0.1 $\mu C/cm^2$ and 0.3 $\mu C/cm^2$; and (2) adjusting the preclean current corona level to a value which charges said wear products with a polarity opposite to the normal triboelectric charge without producing significant toner filming of said photoconductor.

5. The method of claim 4 in which the optimum preclean corona charge density level is equal to the transfer corona charge density level $\pm$0.025 $\mu C/cm^2$.

6. In an electrophotographic machine including a photoconductor moving sequentially through various process stations including a charging station, an imaging station, a developing station, a transfer station including a transfer corona, and a cleaning station including a preclean corona, the improvement comprising:

means for adjusting the charge density produced on the photoconductor by the preclean corona to approximately equal the charge density produced on the photoconductor by the transfer corona $\pm 0.025\ \mu C/cm^2$.

* * * * *